US006132673A

United States Patent [19]

Hille et al.

[11] Patent Number: 6,132,673

[45] **Date of Patent: *Oct. 17, 2000**

[54] COOLING PLATES FOR SHAFT FURNACES

[75] Inventors: Hartmut Hille, Moers; Werner Otremba, Oberhausen, both of Germany

[73] Assignee: SMS Schloemann-Siemag Aktiengesellschaft, Dusseldorf, Germany

[ * ] Notice: This patent is subject to a terminal disclaimer.

[21] Appl. No.: 09/095,275

[22] Filed: Jun. 10, 1998

[30] Foreign Application Priority Data

Jun. 25, 1997 [DE] Germany ..... 197 27 008

[51] Int. Cl.[7] ..... C21B 7/10

[52] U.S. Cl. ..... 266/193; 266/194

[58] Field of Search ..... 266/193, 194

[56] References Cited

U.S. PATENT DOCUMENTS

| | | | |
|---|---|---|---|
| 4,382,585 | 5/1983 | Fischer et al. | 266/193 |
| 5,650,119 | 7/1997 | Hille et al. | 266/193 |
| 5,676,908 | 10/1997 | Kubbutat et al. | 266/193 |
| 5,678,806 | 10/1997 | Hille et al. | 266/193 |
| 5,904,893 | 5/1999 | Stein | 266/194 |

FOREIGN PATENT DOCUMENTS

| | | |
|---|---|---|
| 0705906 | 4/1996 | European Pat. Off. . |
| 0741190 | 11/1996 | European Pat. Off. . |
| 2371652 | 6/1978 | France . |
| 2907511 | 9/1980 | Germany . |
| 195 03 912 A1 | 8/1996 | Germany . |
| 195 45 048 A1 | 11/1996 | Germany . |

*Primary Examiner*—S Kastler
*Attorney, Agent, or Firm*—Friedrich Kueffner

[57] ABSTRACT

Cooling plates for shaft furnaces, particularly blast furnaces, provided with refractory linings, are made of copper or a low-alloy copper alloy and are provided with cooling agent ducts in their interiors. Each cooling plate is manufactured from a rough forged or rolled ingot, wherein the cooling plate has a straight or planar inner side and the cooling ducts are blind-end bores extending in the interior of the cooling plate, wherein the cooling plate is provided at the edge thereof with side flanges, and wherein pipe connections are provided at the ends of the cooling ducts. The cooling body of the forged or rolled copper cooling plate provided with inner blind-end bores and vertical and/or horizontal side flanges on both sides has an arched outer side as well as a planar inner side.

6 Claims, 4 Drawing Sheets

COOLING PLATES FOR SHAFT FURNACES

BACKGROUND OF THE INVENTION

1. Field of the Invention

The present invention relates to cooling plates for shaft furnaces, particularly blast furnaces, provided with refractory linings. The cooling plates are of copper or a low-alloy copper alloy and are provided with cooling agent ducts in their interiors. Each cooling plate is manufactured from a rough forged or rolled ingot, wherein the cooling plate has a straight or planar inner side and the cooling ducts are blind-end bores extending in the interior of the cooling plate, wherein the cooling plate is provided at the edge thereof with side flanges, and wherein pipe connections are provided at the ends of the cooling ducts.

2. Description of the Related Art

Copper cooling plates of the above-described type are usually arranged between the furnace shell and the brick lining of the furnace and are connected to the cooling system of the shaft furnace. On the side facing the interior of the furnace, the cooling elements in the upper portion of the shaft furnace are for the most part covered with refractory material and in the area of the body they are covered with carbon bricks.

In plates of cast copper known in the art, the cooling ducts are formed either by cast steel pipes or the cooling ducts are cast-in directly. The structure of cast copper is not as homogeneous and dense as that of forged or rolled copper. Consequently, the thermal conductivity of cast copper is also poorer and the strength is lower. In the case of cast-in pipes, the thermal conductivity is impaired by an oxide layer between the pipe and the copper block or ingot.

DE-29 07 511 discloses a cooling plate which is manufactured from a rough forged or rolled ingot and in which the cooling ducts are vertically extending blind-end bores produced by mechanical deep drilling. The structure of the cooling plate is significantly denser and more homogeneous than that of a cast copper plate. The strength values are higher than those of the cast copper plate. The desired position of the bores is precisely adhered to with respect to the horizontal and vertical directions and, thus, a uniform heat discharge is ensured.

This cooling plate is provided on the side facing the interior of the furnace with webs and grooves and can be lined with refractory bricks or with a rammed refractory substance.

EP 0 705 906 A1 discloses a cooling plate manufactured from a rough forged or rolled copper ingot in which, in addition to the vertically extending blind-end bores, cooling ducts are provided for cooling the edge zones, wherein the additional cooling ducts are provided in the form of vertical or horizontal blind-end bores having a smaller diameter and arranged in the border zones around the vertically arranged blind-end bores.

DE 195 03 912 A1 discloses a cooling plate manufactured from a rough forged or rolled copper ingot in which, in addition to the vertically extending blind-end bores, an additional cooling element is mounted in the upper or lower portion, wherein the additional cooling element is mounted either so as to be releasable or forged to the cooling plate, wherein additional vertical and horizontal blind-end bores are provided in the additional cooling element and wherein the additional blind-end bores are also connected through copper pipe connections to the cooling system of the blast furnace.

DE 195 45 048 discloses differently constructed cooling plates composed of copper or a low-alloy copper alloy with cooling agent ducts arranged in the interior of the cooling plate, wherein the cooling plate is manufactured from a rough forged or rolled ingot and wherein the cooling ducts are vertically extending blind-end bores.

The cooling plates are provided with vertical side flanges on both sides and/or with horizontal side flanges on both sides, as well as with horizontally arranged webs and grooves on the cooling body facing the interior of the furnace.

The cooling plates are constructed in such a way that the vertical or horizontal side flanges engage into each other in an overlapping manner when mounted on the furnace shell and, thus, form cooling segments or circumferential cooling rings. In one type of the cooling plate, the side flanges are arranged on the side facing the interior of the furnace, and in the other type of cooling plate the side flanges are arranged on the side facing the furnace shell.

However, the arrangement and fastening in the blast furnace of these cooling plates mentioned last have the disadvantage that a gap is formed between the cooling plates and the furnace shell, wherein this gap must be filled with refractory rammed material or with specifically cut refractory bricks. Consequently, the assembly of this cooling system is time-consuming and expensive.

SUMMARY OF THE INVENTION

Therefore, it is the primary object of the present invention to provide a cooling system composed of copper cooling plates in which the copper cooling plates arranged vertically above each other and horizontally next to each other are mounted so closely to the furnace shell of a shaft furnace that no refractory lining is required between the cooling plates and the furnace shell and very little other insulating materials are required.

In accordance with the present invention, a first cooling plate is provided with vertical side flanges on both sides and has a planar inner side and an arched outer side, and a second cooling plate is provided with vertical side flanges on both sides and has a planar inner side and an arched outer side, wherein the planar inner side of the first cooling plate is integrally connected to the vertical side flanges, and the arched outer side of the second cooling plate is integrally connected to the vertical side flange.

Accordingly, in accordance with the present invention, the cooling body of the forged or rolled copper cooling plate provided with inner blind-end bores and vertical and/or horizontal side flanges on both sides has an arched outer side as well as a planar inner side.

The arched outer side of the respective cooling plate is adapted to the respective diameter of the blast furnace or to the location of use in the blast furnace, i.e., the body, the boshes, the coal sack, etc.; in other words, the radius of the furnace shell at the location of use in the blast furnace and the radius of the arched outer side of the cooling plate are essentially identical.

At least three cooling plates are required for forming a horizontal cooling segment, and a plurality of cooling plates are required for forming a complete horizontal cooling ring within the furnace shell.

Because of the overlapping connection of the vertical side flanges of the cooling elements, two different types of cooling plates are required in the conventional manner.

Consequently, both types of cooling plates are provided on the side facing the furnace interior with vertical side flanges on both sides, wherein the side facing the interior of the furnace may be equipped with or without webs and grooves on the cooling body between the side flanges. The other side of the two cooling plates is provided with an arched outer side which is adapted to the radius of the furnace shell. Therefore, the vertical side flanges of the cooling plates are arranged facing the inner side of the blast furnace, on the one hand, and facing the outer side of the blast furnace, i.e., the furnace shell, on the other hand.

In the first type of cooling plate, the planar inner side is seamlessly or integrally connected to the side flange, and in the other type of cooling plate, the arched outer side is seamlessly or integrally connected to the side flange.

If several layers of horizontal cooling segments or complete cooling rings are arranged above each other in the interior of a blast furnace, additional horizontal side flanges can be provided at the front ends of the cooling plates and arranged so as to overlap each other.

Horizontal cooling segments or complete cooling rings can also be formed above each other in the interior of a blast furnace by cooling plates without horizontal side flanges. However, in that case, the cooling segments or complete cooling rings are then mounted so as to abut each other.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
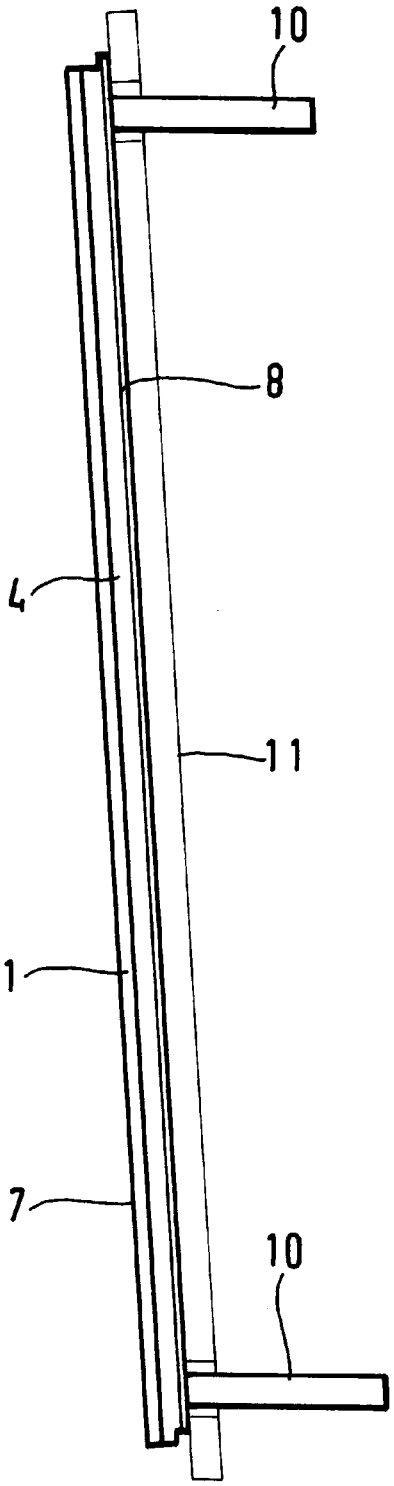
FIG. 1 is a side view of a first type of cooling plate.

FIG. 1 of the drawing is a side view of a cooling plate 1 having an arched outer side 8 which is connected directly to the furnace shell 11.

The pipe connections 10 for the vertical blind-end bores 4 extend through the furnace shell 11 and are connected to the cooling system of the blast furnace.

The planar side 7 of the cooling plate 1 facing the furnace interior is directly connected to a refractory lining of carbon bricks, not shown.

Figure 2:
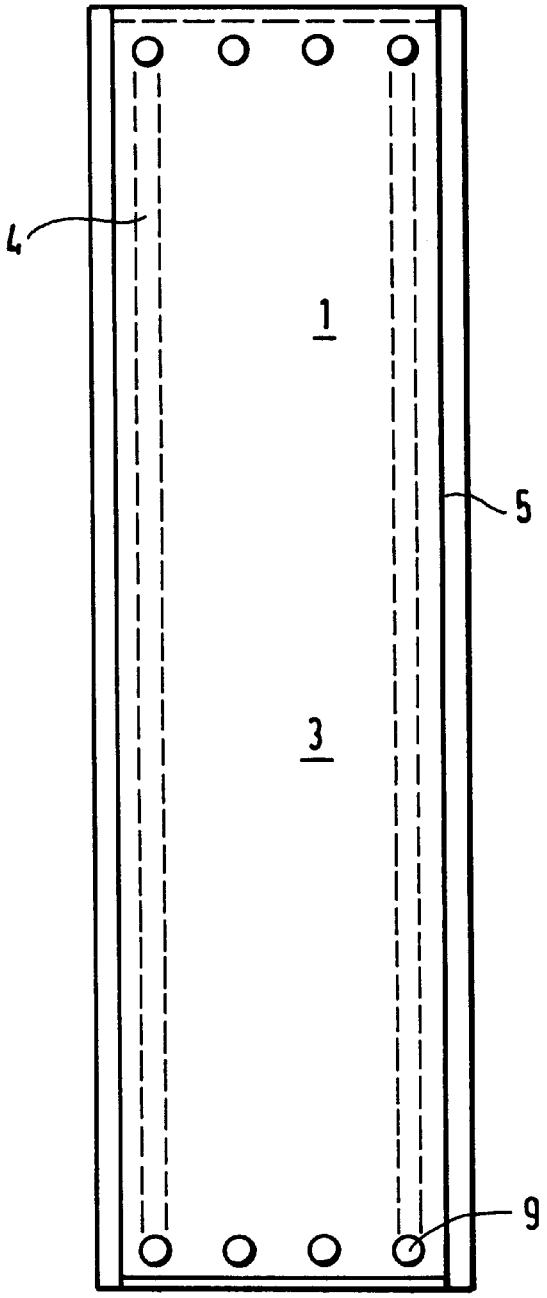
FIG. 2 is a longitudinal sectional view of the cooling plate of FIG. 1.

FIG. 2 is a longitudinal sectional view of the cooling plate 1 showing the blind-end bores 4 in the cooling body 3 in broken lines. Arranged on the sides of the cooling body 3 are vertically extending side flanges 5, and horizontal blind-end bores 9 with openings at the top and bottom of the cooling body 3 are provided.

Figure 3:
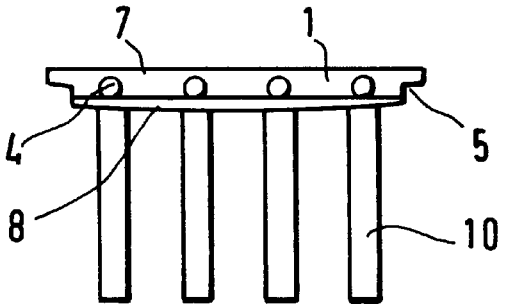
FIG. 3 is a cross-sectional view of the cooling plate of FIG. 1.

FIG. 3 is a cross-sectional view of the cooling plate 1 of FIG. 1, wherein the side flanges 5 can be seen as a direct lateral extension of the planar inner side 7 of the cooling plate 1. The side 8 of the cooling plate 1 on the side facing away from the inner side 7 has an arched surface in which the pipe connections 10 for supplying and discharging the cooling water are provided.

Figure 4:
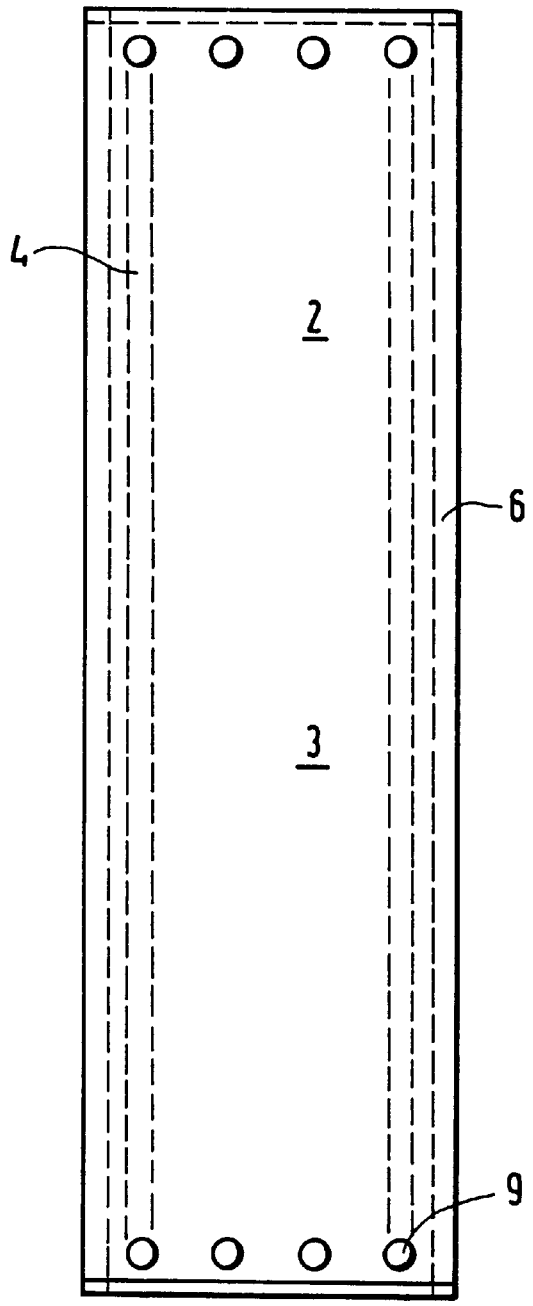
FIG. 4 is a longitudinal sectional view of a second type of cooling plate.

FIG. 4 is a longitudinal sectional view of a second type of cooling plate 2 with blind-end bores 4 shown in broken lines in the cooling body 3. The cooling plate 2 is provided with vertically extending side flanges 6 arranged laterally of the cooling body 3 and with blind-end bores 9 with openings at the upper portion or lower portion of the cooling body 3.

Figure 5:
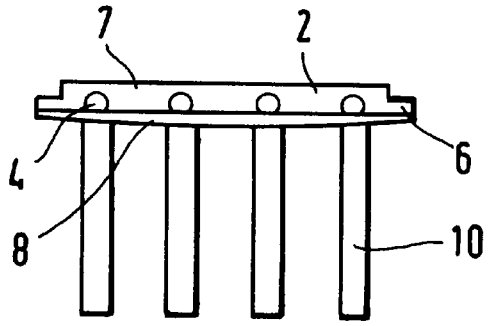
FIG. 5 is a cross-sectional view of the cooling plate of FIG. 4.

FIG. 5 is a cross-sectional view of the cooling plate 2, wherein the side surface 6 can be seen as a direct lateral extension of the arched outer side 8. As illustrated in FIG. 5, the inner side 7 of the cooling plate 2 also has a planar surface. Also in this case, the pipe connections 10 are provided at the arched outer side 8 for supplying and discharging the cooling water.

Figure 6:
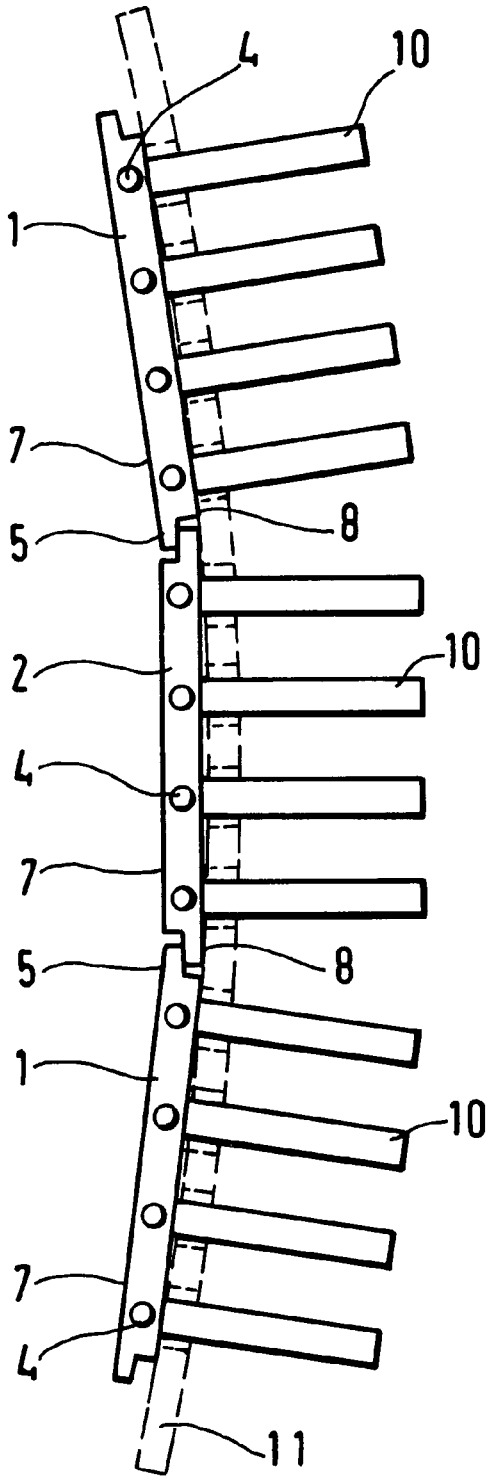
FIG. 6 is a top view of the arrangement of a cooling ring in a blast furnace.

FIG. 6 is a top view showing the arrangement of a cooling ring at the furnace shell 11 of a blast furnace. The cooling ring is composed of alternatingly arranged cooling plates 1 and 2, wherein the arched outer sides 8 of the cooling plates 1, 2 rest tightly against the furnace shell 11 and the side flanges 5 of the cooling plates 1 overlap the side flanges 6 of the cooling plates 2.

As already mentioned above, the cooling water is supplied to and discharged from the blind-end bores 4 through pipe connections 10 which are in communication with the cooling cycle of the blast furnace.

While specific embodiments of the invention have been shown and described in detail to illustrate the inventive principles, it will be understood that the invention may be embodied otherwise without departing from such principles.

We claim:

1. An arrangement of cooling plates for shaft furnaces provided with a refractory lining, each cooling plate being comprised of copper or a low-alloy copper alloy, each cooling plate being manufactured of a rough forged or rolled ingot and provided with internal blind-end bores forming cooling ducts, and pipe connections provided at ends of the cooling ducts, further comprising a first cooling plate comprising vertical side flanges on both sides and having a planar inner side and an arched outer side, a second cooling plate comprising vertical side flanges on both sides and having a planar inner side and an arched outer side, wherein the planar inner side of the first cooling plate is seamlessly connected to the vertical side flanges of the first cooling plate, and wherein the arched outer side of the second cooling plate is seamlessly connected to the vertical side flanges of the second cooling plate.

2. The arrangement according to claim 1, comprising webs and grooves provided on the planar inner side of the first cooling plate.

3. The arrangement according to claim 1, comprising webs and grooves provided on the planar inner side of the second cooling plate.

4. The arrangement according to claim 1, wherein two first cooling plates and a second cooling plate form a cooling segment within the furnace shell.

5. The arrangement according to claim 1, wherein one first cooling plate and two second cooling plates form a cooling segment within the furnace shell.

6. The arrangement according to claim 1, comprising a plurality of first cooling plates and second cooling plates forming a circumferential cooling ring within the furnace shell.

* * * * *